US005836840A

United States Patent [19]

Bustamante et al.

[11] Patent Number: 5,836,840

[45] Date of Patent: Nov. 17, 1998

[54] HYDROPLANING DISK

[75] Inventors: Michael J. Bustamante, Southlake; Jonathan J. Britt, Grapevine, both of Tex.

[73] Assignee: Pungur Corporation, Southlake, Tex.

[21] Appl. No.: 905,071

[22] Filed: Aug. 1, 1997

[51] Int. Cl.[6] ..... A63B 65/10

[52] U.S. Cl. ..... 473/588

[58] Field of Search ..... 473/588, 589, 473/224, 225, 383

[56] References Cited

U.S. PATENT DOCUMENTS

| | | | |
|---|---|---|---|
| 4,216,611 | 8/1980 | Psyras | 473/588 |
| 5,200,573 | 4/1993 | Blood | 473/383 |
| 5,320,361 | 6/1994 | Hellerman | 473/588 |
| 5,484,159 | 1/1996 | Dean et al. | 473/588 |

FOREIGN PATENT DOCUMENTS

| | | | |
|---|---|---|---|
| 181801 | 4/1955 | Austria | 473/224 |

*Primary Examiner*—William H. Grieb
*Attorney, Agent, or Firm*—Carstens Yee & Cahoon

[57] ABSTRACT

A hydroplaning disk for safely projecting and skimming or skipping upon and across the surface of a body of water at the air-water interface for sport or recreation. The hydroplaning disk includes an ellipsoidal bottom surface, a top surface, and a deformable rim. The deformable rim deforms and returns to its original shape after absorbing impact energy. The top surface has an aerodynamic lip section with a leading edge portion, a peak portion, and a trailing edge portion. The aerodynamic lip section is integrated with a trough portion. The trough portion is integrated with an upraised central dome portion that has a central dimple which intrudes into the dome portion. The trough portion includes a water collecting groove and bailing channels. The ellipsoidal bottom surface includes anti-friction grooves or dimples. The hydroplaning disk has gripping means to provide a secure grip for throwing when hydroplaning disk is wet, and grasping means for safely throwing and catching the hydroplaning disk.

33 Claims, 4 Drawing Sheets

HYDROPLANING DISK

BACKGROUND OF THE INVENTION

1. Field of the Invention

This invention relates to hydroplaning disks, especially those that are projected for safely skimming or skipping upon and across the surface of a body of water at the air-water interface for sport or recreation.

2. Background Information

Recreational hydroplaning disks for throwing and skimming or skipping across bodies of water have been known for many years. Some hydroplaning disks are designed to skim across the water while maintaining constant contact with the air-water interface, and others are designed to skip across the water, only intermittently contacting the air-water interface. These hydroplaning devices lack the hydromechanical and aerodynamic characteristics to both skim and skip across the water for long distances and along straight paths. In addition, most known hydroplaning devices are manufactured of stone or other rigid material and can cause injury or damage to people or property upon impact therewith.

Accordingly, it is the general object of the invention to provide a safe hydroplaning disk including an ellipsoidal bottom surface, an aerodynamic top surface, and a deformable rim for both skimming and skipping upon and across the surface of a body of water at the air-water interface for long distances in straight paths.

SUMMARY OF THE INVENTION

A hydroplaning disk is provided with an ellipsoidal bottom surface integrated with a an impact-absorbing deformable rim, the deformable rim having a circular peripheral edge; and a top surface, also integrated with the deformable rim. The hydroplaning disk is projected for safely skimming or skipping upon and across the surface of a body of water at the air-water interface.

In an alternate embodiment, a hydroplaning disk is provided with an ellipsoidal bottom surface integrated with a an impact-absorbing deformable rim, the deformable rim having a circular peripheral edge; and a top surface, also integrated with the deformable rim, the top surface including an aerodynamic lip section with a radially exterior leading edge portion that extends radially inwardly and upwardly from the peripheral edge to an upraised peak portion, a trailing edge portion that extends radially inwardly and downwardly from the peak portion, a trough section integrated with the trailing edge portion, a central dome section of selected geometry integrated with the trough section, and a concave dimple of selected geometry intruding into the dome section forming a dome ridge.

In another embodiment, a hydroplaning disk is provided with a water collecting groove integrated into the trough section, the water collecting groove having bailing channels extending outwardly therefrom for the removal of water by centrifugal force which has pooled in the trough section.

In another embodiment, a hydroplaning disk is provided with either radial or concentric anti-friction grooves, the anti-friction grooves being integrated into the bottom surface to reduce drag and allow the hydroplaning disk to travel faster, farther and straighter.

BRIEF DESCRIPTION OF THE DRAWINGS

The drawings are for illustrative purposes only and are not drawn to scale.

DESCRIPTION OF THE PREFERRED EMBODIMENT

Figure 1:
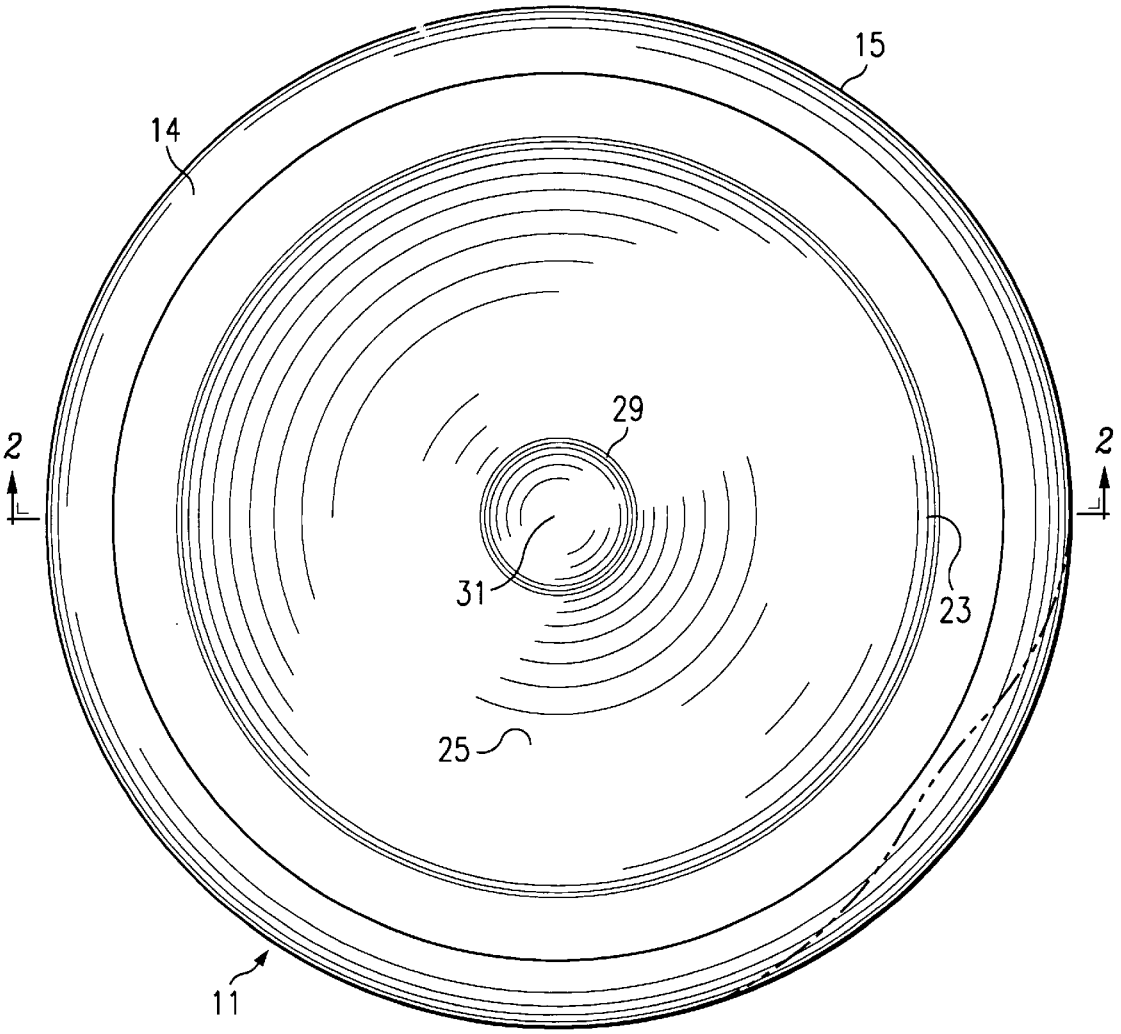
FIG. 1 is a top view of the hydroplaning disk of the present invention.
Figure 2:
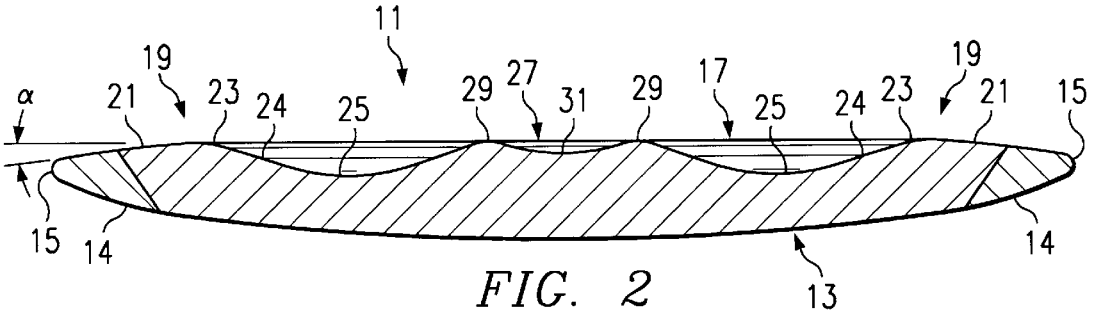
FIG. 2 is a cross-sectional view of the hydroplaning disk of FIG. 1 taken at II—II.

With reference now to the drawings, and in particular with reference to FIG. 1 and FIG. 2, the preferred embodiment of a hydroplaning disk 11 of the present invention is illustrated. Hydroplaning disk 11 has an ellipsoidal bottom surface 13 integrated with an impact-energy absorbing deformable rim 14. Deformable rim 14 has a circular peripheral edge 15. Ellipsoidal bottom surface 13 smoothly transitions into deformable rim 14. Hydroplaning disk 11 has a top surface 17 that is also integrated with deformable rim 14. Top surface 17 smoothly transitions into deformable rim 14. Bottom surface 13 and top surface 17 of hydroplaning disk 11 are preferably manufactured of rigid, buoyant plastic. Deformable rim 14 is preferably manufactured of pliable foam that deforms upon impact and returns to its original shape after impact. Deformable rim 14 prevents injury or damage when hydroplaning disk 11 collides with a person or other property. Such deformation is illustrated by dashed lines on FIG. 1. Hydroplaning disk 11 is preferably about 11.75 inches in diameter and about 1.0625 inches in overall thickness.

Continuing with reference to FIG. 1 and FIG. 2, top surface 17 has an aerodynamic lip section 19 with a leading edge portion 21 that extends inwardly and upwardly from peripheral edge 15, an upraised peak portion 23 integrated with leading edge portion 21, a trailing edge portion 24 that extends inwardly and downwardly from peak portion 23, and a trough portion 25 integrated with trailing edge portion 24. Peak portion 23 is preferably upraised 0.25 inches, as measured axially from peripheral edge 15. Leading edge portion 21 forms and angle a, preferably of 40 degrees, with the horizontal. Trough portion 25 is integrated with an upraised central dome section 27. The preferred maximum depth of trough portion is 0.75 inches, as measured axially from peak portion 23. A concentric sunken dimple 31 intrudes into dome section 27 forming an annular dome ridge 29. Peak portion 23 of aerodynamic lip section 19 is preferably located on hydroplaning disk 11 at a radius of about 4.7188 inches. Dimple 31 is preferably located on hydroplaning disk 11 (see FIG. 1) at a radius of about 0.7188 inches and intrudes a depth of about 0.125 inches into dome section 27.

Figure 2A:
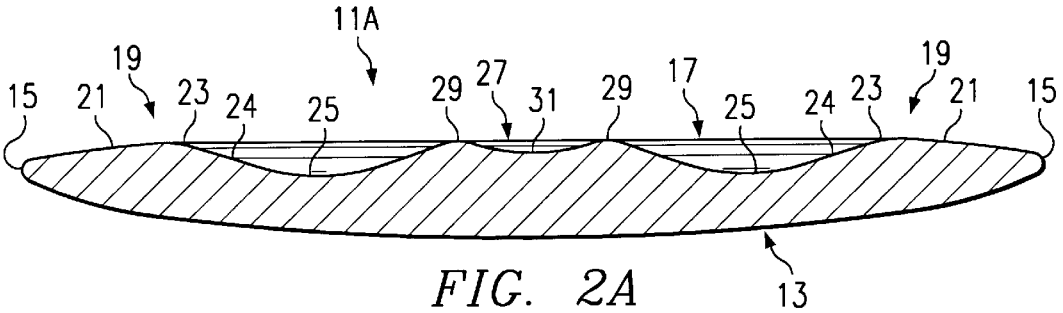
FIG. 2A is a cross-sectional view of the hydroplaning disk of FIG. 1 taken at II—II for an embodiment constructed of a single material.

Referring now to FIG. 2A in the drawings, an alternate embodiment of hydroplaning disk 11 is illustrated. Hydroplaning disk 11A is identical to hydroplaning disk 11 with the exception that it lacks a deformable rim. Hydroplaning disk 11A is preferably manufactured of a pliable material that will deform upon impact to prevent injury and damage to people and property.

Figure 3:
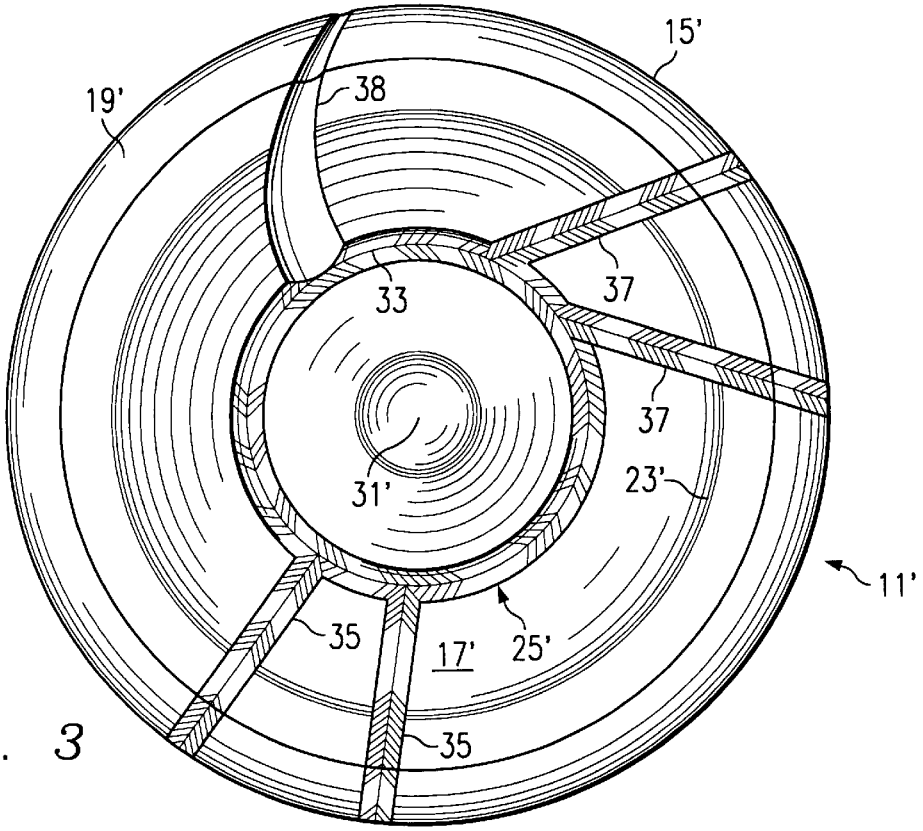
FIG. 3 is a top view of an alternate embodiment of the hydroplaning disk of the present invention with a water collecting groove and various bailing channels.

Referring now to FIG. 3 in the drawings, an alternate embodiment of top surface 17 of hydroplaning disk 11 of FIG. 1 is illustrated. Hydroplaning disk 11' has at least one water collecting groove 33 integrated into trough section 25'. Water collecting groove 33 is preferably a V-shaped groove to collect water that has washed over peak portion 23' of aerodynamic lip section 19' and pooled in trough portion 25'. A plurality of bailing channels 35 are integrated into top surface 17' and are in fluid communication with water collecting groove 33. Bailing channels 35 extend radially outward to peripheral edge 15'. Bailing channels 35 are preferably V-shaped and located at periodic distances around hydroplaning disk 11'. Alternate bailing channels 37 are also integrated into top surface 17' and in fluid communication with water collecting groove 33. Bailing channels 37 extend outwardly at a selected angle to the radius to peripheral edge 15'. Bailing channels 37 are preferably V-shaped and located at periodic distances around hydroplaning disk 11'. Additional alternate bailing channels 38 are also integrated into top surface 17' and in fluid communication with water collecting groove 33. Bailing channels 38 spiral outwardly to peripheral edge 15'. Bailing channels 38 are preferably U-shaped and located at periodic distances around hydroplaning disk 11'. Bailing channels 35, 37, and 38 allow water pooled in trough portion 25' to drain off of hydroplaning disk 11' by centrifugal force as hydroplaning disk 11' rotates. It is understood that similar bailing channels may also be located within dimple 31'.

Figure 4:
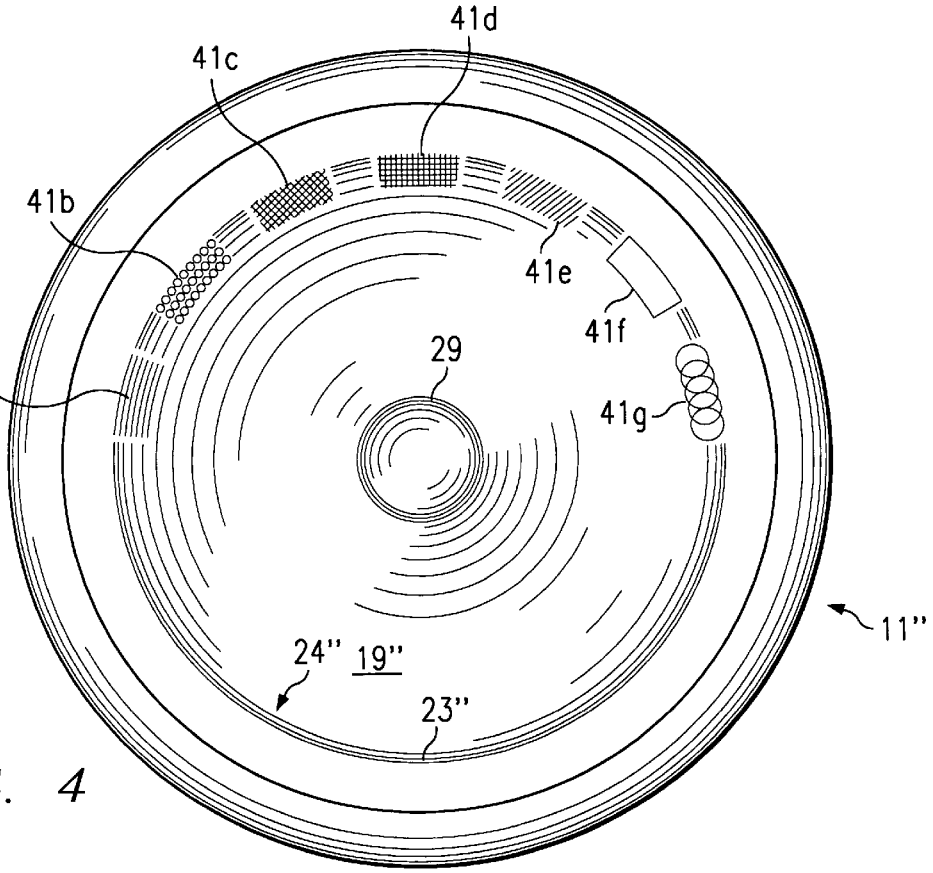
FIG. 4 is a top view of an alternate embodiment of the hydroplaning disk of the present invention illustrating various gripping means.

Referring now to FIG. 4 in the drawings, an alternate embodiment of top surface 17 of hydroplaning disk 11 of FIG. 1 is illustrated. A variety of alternate gripping means 41*a*, 41*b*, 41*c*, 41*d*, 41*e*, 41*f*, and 41*g* are illustrated. Gripping means 41*a*, 41*b*, 41*c*, 41*d*, 41*e*, 41*f*, or 41*g* are disposed on trailing edge portion 24" of aerodynamic lip section 19" and aid in gripping and throwing hydroplaning disk 11" when wet. Gripping means 41*a*, 41*b*, 41*c*, 41*d*, 41*e*, 41*f*, or 41*g* can take on a variety of forms, such as integrated annular raised ridges 41*a*; integrated annular raised dimples 41*b*; or integrated cross-hatched patterns 41*c*, 41*d*, or 41*e*. Gripping means may also be strips of abrasive material 41*f* or 41*g* adhered to trailing edge portion 24" of aerodynamic lip section 19". It is understood that it is preferable to include gripping means 41*a*, 41*b*, 41*c*, 41*d*, 41*e*, 41*f*, or 41*g* on all embodiments of the present invention.

Figure 5:
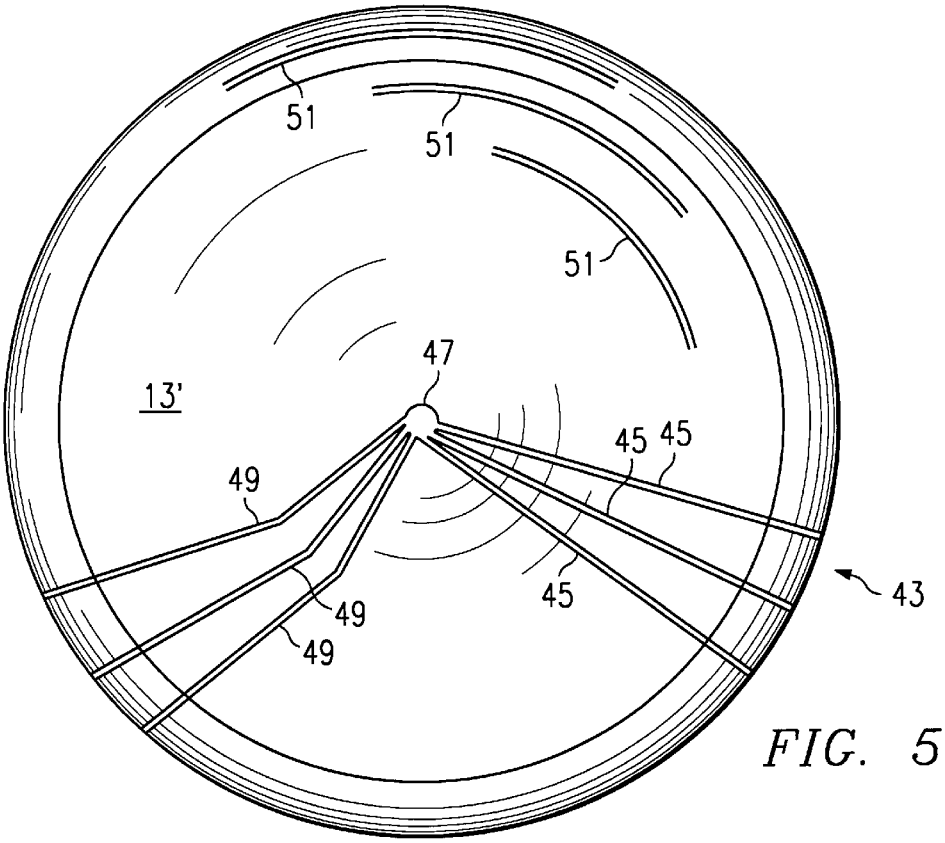
FIG. 5 is a bottom view of an alternate embodiment of the hydroplaning disk of the present invention illustrating various anti-friction grooves.

Referring now to FIG. 5 in the drawings, an alternate embodiment of bottom surface 13 of hydroplaning disk 11 of FIG. 2 is illustrated. Hydroplaning disk 43 has a plurality of anti-friction grooves 45 integrated into bottom surface 13'and extending radially outward from a center 47 of bottom surface 13'. In an alternate embodiment, angled anti-friction grooves 49 are integrated into bottom surface 13'and extend outwardly from center 47 of bottom surface 13'. In an additional alternate embodiment, circular anti-friction grooves 51 are integrated into bottom surface 13'and form concentric circles about center 47 of bottom surface 13'. Anti-friction grooves 45, 49, and 51 are preferably semi-circular in cross-section, about 0.0625 inches in diameter, and selectively spaced around bottom surface 13'. As hydroplaning disk 43 skims or skips across the water (not shown) at the air-water interface (not shown), water builds up in anti-friction grooves 45, 49, and 51, thereby reducing the drag between hydroplaning disk 43 and the water. This reduction in drag allows hydroplaning disk 43 to travel a straighter path and obtain higher rotational and translational speeds across the water. Increasing the number of anti-friction grooves 45, 49, or 51, increases the rotational and translational speed of hydroplaning disk 43. The number of anti-friction grooves 45, 49, or 51 should be selected to ensure that hydroplaning disk 43 travels at safe speeds.

Figure 6:
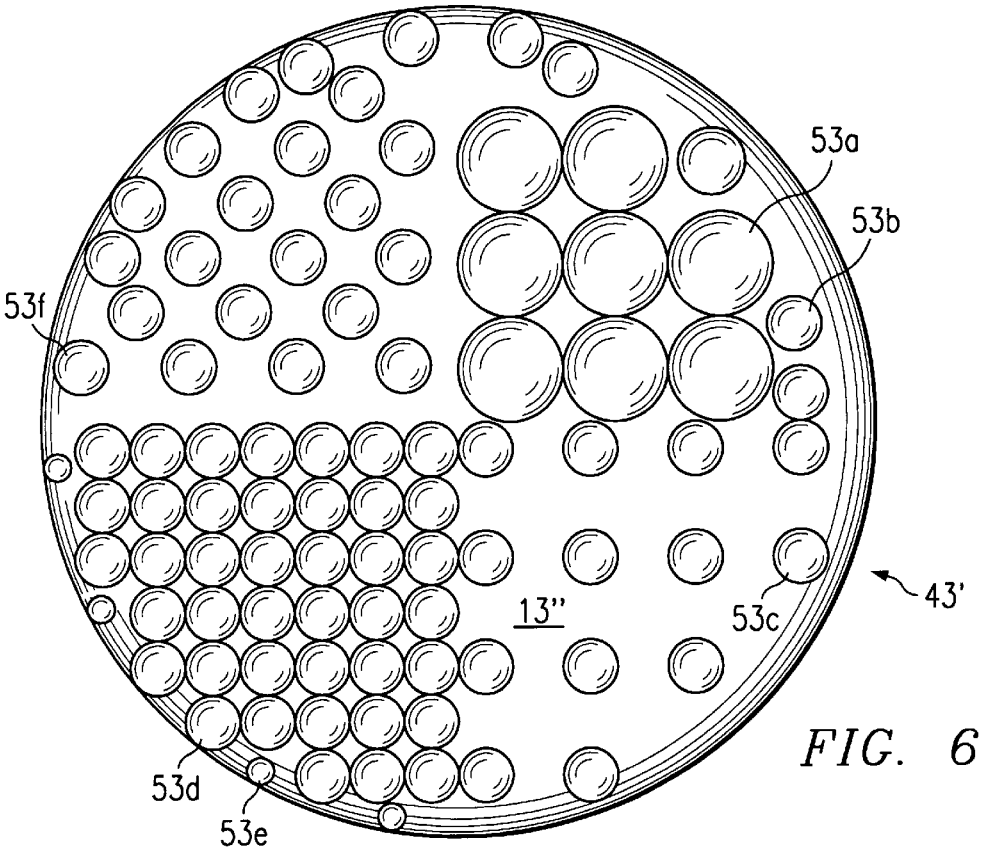
FIG. 6 is a bottom view of an alternate embodiment of the hydroplaning disk of the present invention illustrating various anti-friction dimple patterns.

Referring now to FIG. 6 in the drawings, an alternate embodiment of hydroplaning disk 43 of FIG. 5 is illustrated. Hydroplaning disk 43' has a plurality of anti-friction dimples 53*a*, 53*b*, 53*c*, 53*d*, 53*e*, and 53*f* in a variety of sizes and patterns that are integrated into bottom surface 13". As hydroplaning disk 43' skims or skips across the water at the air-water interface, water builds up in anti-friction dimples 53*a*, 53*b*, 53*c*, 53*d*, 53*e*, and 53*f*, thereby reducing the drag between hydroplaning disk 43' and the water. This reduction in drag allows hydroplaning disk 43' to obtain higher rotational and translational speeds across the water. Increasing the number of anti-friction dimples 53*a*, 53*b*, 53*c*, 53*d*, 53*e*, or 53*f* increases the rotational and translational speed of hydroplaning disk 43'. Decreasing the diameter of anti-friction dimples 53*a*, 53*b*, 53*c*, 53*d*, 53*e*, or 53*f* increases the rotational and translational speed of hydroplaning disk 43'. The number and diameter of anti-friction dimples 53*a*, 53*b*, 53*c*, 53*d*, 53*e*, or 53*f* should be selected to ensure that hydroplaning disk 43' travels at safe speeds.

Figure 7:
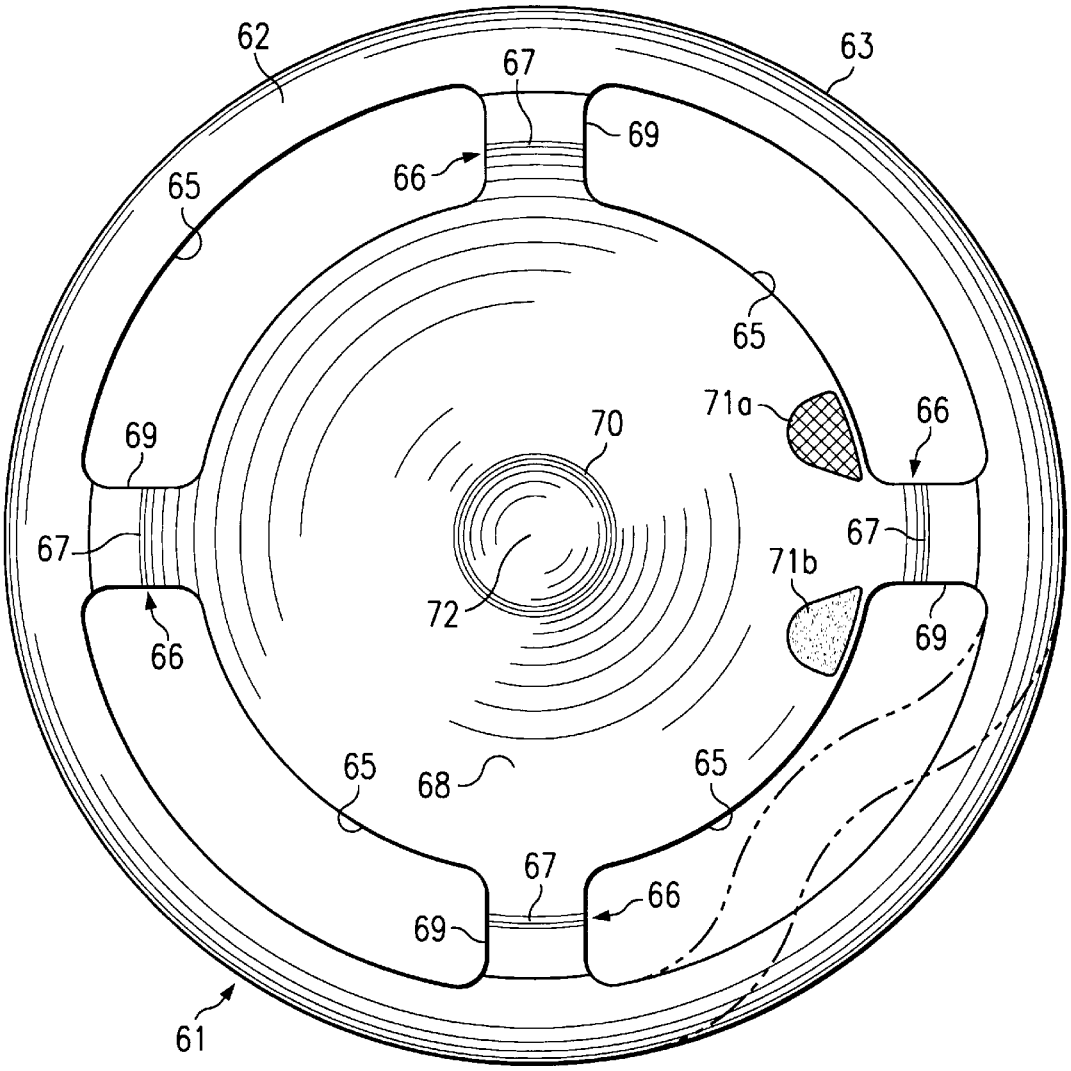
FIG. 7 is a top view of an alternate embodiment of the hydroplaning disk of the present invention including grasping means.

Referring now to FIG. 7 in the drawings, an alternate embodiment of hydroplaning disk 11 of FIG. 1 and FIG. 2 is illustrated. A hydroplaning disk 61 is identical to hydroplaning disk 11 with the exception of the addition of at least two grasping means 63. Hydroplaning disk 61 includes a deformable rim 62, an aerodynamic lip section 66 with a peak portion 67, a trough portion 68, a dome portion 70, and a sunken dimple 72. Grasping means 63 are formed by generally annular apertures 65 that pass axially through hydroplaning disk 61 near aerodynamic lip section 66. Apertures 65 are separated by radially extending spokes 69. Grasping means 63 allow users to grab hydroplaning disk 61 when throwing and catching. Gripping means 71*a* and 71*b* are similar to gripping means 41*a*, 41*b*, 41*c*, 41*d*, 41*e*, 41*f*, or 41*g* of FIG. 4. Grasping means 63 are preferably integrated into deformable rim 62. Grasping means 63 deform to absorb impact energy and prevent injury or damage to people or property when hydroplaning disk 61 impacts therewith. Typical deformation of grasping means 63 is shown by dashed lines in FIG. 7.

Figure 8:
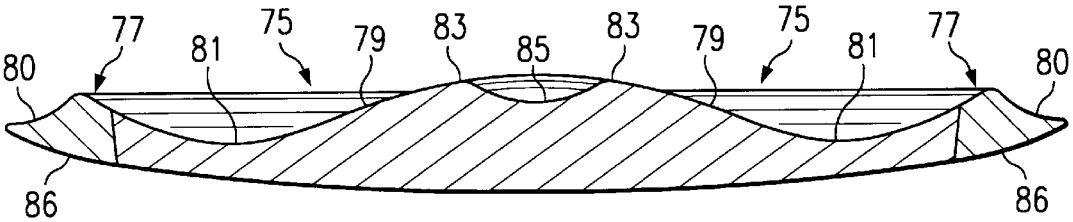
FIG. 8 is a cross-sectional view of an alternate embodiment of the hydroplaning disk of the present invention with a concave leading edge portion.

Referring now to FIG. 8 in the drawings, a cross-sectional view of an alternate embodiment of hydroplaning disk 11 of FIG. 1 and FIG. 2 is illustrated. A hydroplaning disk 75 is identical to hydroplaning disk 11 with the exception that the annular aerodynamic lip section 77 of top surface 79 has a concave leading edge portion 80. Aerodynamic lip section 77 is integrated with a radially interior trough portion 81. Trough portion 81 is integrated with a radially interior dome portion 83. A concentric sunken dimple 85 intrudes into dome portion 83. Hydroplaning disk 75 has a deformable rim 86 similar to deformable rim 14.

Referring now again to the preferred embodiment of FIG. 1 and FIG. 2, in operation, hydroplaning disk 11 is thrown or projected by a user with high rotational velocity such that the ellipsoidal bottom surface 13 skims or skips upon and across the surface of a body of water at the air-water interface. The user places his thumb or fingers on gripping means 41*a*, 41*b*, 41*c*, 41*d*, 41*e*, 41*f*, or 41*g* (see FIG. 4) to obtain a more secure grip when hydroplaning disk 11 is wet. It is preferred to project hydroplaning disk 11 with high rotational velocity, as the high rotational velocity and the increased concentrated mass of central dome portion 27 has a gyroscopic effect on hydroplaning disk 11 and allows hydroplaning disk 11 to translate across the water in a generally straight path and at high translational velocity. Hydroplaning disk 11 may also be caught and thrown by using grasping means 63 (see FIG. 7). Because hydroplaning disk 11 is preferably manufactured of buoyant plastic or foam material, hydroplaning disk 11 resists sinking into the body of water.

Although the invention has been described with reference to a preferred embodiment, this description is not to be construed in a limiting sense. Various modifications of the disclosed embodiment as well as alternative embodiments of the invention will become apparent to persons skilled in the art upon reference to the description of the invention.

I claim:

1. A hydroplaning disk comprising:

a bottom surface;

a deformable rim with a circular peripheral edge; and a top surface joined to the bottom surface at the peripheral edge, the top surface including:

an aerodynamic rim section with a leading edge portion that extends inwardly and upwardly from the peripheral edge to an upraised annular peak portion, a trailing edge portion that extends inwardly and downwardly from the peak portion to a trough portion; and an upraised central dome section of selected geometry integrated with the trough portion, wherein the hydroplaning disk is projected for safely skimming or skipping upon and across the surface of a body of water at the air-water interface.

2. The hydroplaning disk according to claim 1, wherein the top surface further comprises:

a central concave dimple intruding into the dome section.

3. The hydroplaning disk according to claim 2, wherein the dimple has a diameter from about 0.5 inches to about 16 inches.

4. The hydroplaning disk according to claim 1, further comprising:

at least one annular water collecting groove integrated into the trough portion; and at least one bailing channel extending outwardly from the water collection groove to the peripheral edge;

whereby water which has pooled in the trough portion is removed by the centrifugal force of the hydroplaning disk as it rotates.

5. The hydroplaning disk according to claim 4, wherein the bailing channels spiral outwardly from the collecting groove to the trough portion.

6. The hydroplaning disk according to claim 1 wherein the leading edge portion is concave.

7. The hydroplaning disk according to claim 1 further comprising:

a plurality of gripping means disposed on the top surface for secure catching and throwing of the hydroplaning disk when wet.

8. The hydroplaning disk according to claim 7 wherein the gripping means are strips of abrasive tape.

9. The hydroplaning disk according to claim 1 further comprising:

a plurality of gripping means disposed on the trailing edge portion, the gripping means being raised dimple patterns for secure catching and throwing of the hydroplaning disk when wet.

10. The hydroplaning disk according to claim 9 wherein the gripping means are raised cross-hatched patterns.

11. The hydroplaning disk according to claim 9 wherein the gripping means are strips of abrasive tape.

12. The hydroplaning disk according to claim 1 further comprising:

a plurality of grasping means to aid in throwing and catching the hydroplaning disk.

13. The hydroplaning disk according to claim 12 wherein the grasping means comprises:

at least two apertures passing axially through the hydroplaning disk; and at least two spokes separating the apertures;

wherein the grasping means are deformable to absorb impact energy and prevent injury or damage to people or property.

14. The hydroplaning disk according to claim 1 further comprising:

a plurality of anti-friction grooves integrated into the bottom surface to collect water and reduce drag, thereby allowing the hydroplaning disk to travel straighter, faster, and farther.

15. The hydroplaning disk according to claim 14 wherein the anti-friction grooves are radially extending grooves.

16. The hydroplaning disk according to claim 14 wherein the anti-friction grooves are angled grooves.

17. The hydroplaning disk according to claim 14 wherein the anti-friction grooves are concentric circular grooves.

18. The hydroplaning disk according to claim 1 further comprising:

a plurality of anti-friction dimples integrated into the bottom surface to collect water and reduce drag, thereby allowing the hydroplaning disk to travel straighter, faster, and farther.

19. The hydroplaning disk according to claim 1, wherein the peripheral edge has a diameter from about 2 to about 18 inches.

20. The hydroplaning disk according to claim 1, wherein the hydroplaning disk has an overall axial thickness from about 0.125 to about 4 inches.

21. The hydroplaning disk according to claim 1, wherein the peak portion is upraised axially from about 0 to about 2 inches above the peripheral edge.

22. The hydroplaning disk according to claim 1, wherein the leading edge portion forms and angle from about 0 to about 50 degrees with the horizontal.

23. The hydroplaning disk according to claim 1, wherein the trough portion has a maximum axial depth from about 0 to about 4 inches from peak portion.

24. The hydroplaning disk according claim 1, wherein the bottom surface is an ellipsoidal bottom surface.

25. A hydroplaning disk comprising:

a bottom surface;

a deformable rim with a circular peripheral edge; an aerodynamic top surface joined to the bottom surface at the peripheral edge comprising:

an aerodynamic rim section with a leading edge portion that extends inwardly and upwardly from the peripheral edge to an upraised annular peak portion, a trailing edge portion that extends inwardly and downwardly from the peak portion to a trough portion;

an upraised central dome section of selected geometry integrated with the trough portion; and a central concave dimple intruding into the dome section;

at least one water collecting groove integrated into the trough portion;

at least one bailing channel extending outwardly from the water collection groove to the peripheral edge, whereby water which has pooled in the trough portion is removed by the centrifugal force of the hydroplaning disk as it rotates;

a plurality of gripping means disposed on the aerodynamic rim section for secure catching and throwing of the hydroplaning disk when wet;

a plurality of grasping means to aid in throwing and catching the hydroplaning disk comprising:

at least two apertures passing axially through the hydroplaning disk; and at least two spokes separating the apertures, wherein the grasping means are deformable to absorb impact energy and prevent injury or damage to people or property; and a plurality of anti-friction grooves integrated into the bottom surface to collect water and reduce drag, thereby allowing the hydroplaning disk to travel straighter, faster, and farther;

wherein the hydroplaning disk is projected for safe skimming or skipping upon and across the surface of a body of water at the air-water interface.

26. The hydroplaning disk according to claim 25 wherein the gripping means are raised dimple patterns disposed on the trailing edge portion.

27. The hydroplaning disk according to claim 25 wherein the gripping means are raised cross-hatched patterns disposed on the trailing edge portion.

28. The hydroplaning disk according to claim 25 wherein the gripping means are strips of abrasive tape disposed on the trailing edge portion.

29. The hydroplaning disk according to claim 25 wherein the anti-friction grooves are radially extending grooves.

30. The hydroplaning disk according to claim 25 wherein the anti-friction grooves are angled grooves.

31. The hydroplaning disk according to claim 25 wherein the anti-friction grooves are concentric circular grooves.

32. The hydroplaning disk according to claim 25 wherein the anti-friction grooves are substituted with a plurality of anti-friction dimples integrated into the bottom surface to collect water and reduce drag, thereby allowing the hydroplaning disk to travel straighter, faster, and farther.

33. The hydroplaning disk according claim 25, wherein the bottom surface is an ellipsoidal bottom surface.

* * * * *